US009412295B2

(12) United States Patent
Okuno et al.

(10) Patent No.: US 9,412,295 B2
(45) Date of Patent: Aug. 9, 2016

(54) PIXEL CIRCUIT AND DRIVING METHOD THEREOF

(71) Applicant: SAMSUNG DISPLAY CO., LTD., Yongin, Gyeonggi-Do (KR)

(72) Inventors: Takeshi Okuno, Yokohama (JP); Masayuki Kumeta, Yokohama (JP); Eiji Kanda, Yokohama (JP); Ryo Ishii, Yokohama (JP); Naoaki Komiya, Yokohama (JP)

(73) Assignee: SAMSUNG DISPLAY CO., LTD., Yongin, Gyeonggi-do (KR)

( * ) Notice: Subject to any disclaimer, the term of this patent is extended or adjusted under 35 U.S.C. 154(b) by 134 days.

(21) Appl. No.: 14/269,439

(22) Filed: May 5, 2014

(65) Prior Publication Data

US 2014/0333214 A1 Nov. 13, 2014

(30) Foreign Application Priority Data

May 7, 2013 (JP) ..... 2013-097859

(51) Int. Cl.
*G09G 3/32* (2016.01)

(52) U.S. Cl.
CPC ..... *G09G 3/32* (2013.01); *G09G 3/3233* (2013.01); *G09G 3/3291* (2013.01); *G09G 2300/0861* (2013.01)

(58) Field of Classification Search
CPC ..... G09G 3/32; G09G 3/3233; G09G 3/3291; G09G 2300/0861; G09G 3/30
See application file for complete search history.

(56) References Cited

U.S. PATENT DOCUMENTS

2012/0001896 A1* 1/2012 Han ..... G09G 3/3233 345/214
2013/0293600 A1* 11/2013 Lee ..... G09G 3/3258 345/691

FOREIGN PATENT DOCUMENTS

| | | | |
|---|---|---|---|
| JP | 2005-128521 | A | 5/2005 |
| JP | 2008-151963 | A | 7/2008 |
| JP | 2008-225506 | A | 9/2008 |
| JP | 2009-204664 | A | 9/2009 |
| JP | 2009-265328 | A | 11/2009 |
| JP | 2011-199214 | A | 10/2011 |
| JP | 2013-061452 | A | 4/2013 |

* cited by examiner

*Primary Examiner* — Premal Patel
(74) *Attorney, Agent, or Firm* — Lee & Morse, P.C.

(57) ABSTRACT

A pixel circuit including a light emitting element outputting a gray scale based on a current supplied thereto, a first transistor configured to control an amount of current supplied to the light emitting element based on a gray scale data voltage supplied to a gate electrode of the first transistor, a second transistor connected between the gate electrode of the first transistor and an initialization voltage, a third transistor connected between the gate electrode of the first transistor and a first terminal of the first transistor; a fourth transistor connected between the first terminal of the first transistor and the light emitting element, and a fifth transistor connected between a second terminal of the first transistor and a data line. The data line is selectively supplied with the gray scale data voltage and a power supply voltage for light emitting of the light emitting element to the fifth transistor.

8 Claims, 14 Drawing Sheets

PIXEL CIRCUIT AND DRIVING METHOD THEREOF

CROSS-REFERENCE TO RELATED APPLICATION

Japanese Patent Application No. 2013-097859, filed on May 7, 2013, in the Japanese Intellectual Property Office, and entitled: "Pixel Circuit and Driving Method Thereof," is incorporated by reference herein in its entirety.

BACKGROUND

1. Field

Embodiments described herein relate to an electrical optical device, and more particularly, relate to a pixel circuit and a method of driving the pixel circuit.

2. Description of the Related Art

In recent years, display devices replacing CRT (Cathode Ray Tube) displays include organic EL devices that have self-emissive elements. For example, the organic EL device may be used as a backlight for a liquid crystal display (LCD) device or as an organic EL display device. In particular, the organic EL display device has attracted attention.

In the organic EL display device, a gray scale to be expressed is realized by controlling a driving transistor of each pixel circuit and the amount of current supplied to a light emitting diode thereof. If a characteristic of the driving transistor varies, the gray scale expression varies; hence, the quality of display is lowered.

To suppress influence of a variation in characteristic of a driving transistor on gray scale expression, a threshold voltage compensation technique is being developed which suppresses a variation in a threshold voltage (Vth) of a transistor.

A threshold voltage compensation circuit controls the amount of current to be supplied to a light emitting element using input image data, without depending on a variation in a threshold voltage of a driving transistor. Thus, it is possible to compensate for a variation in the threshold voltage of the driving transistor effectively and to improve uniformity of expression of the organic EL display device markedly. However, complexity and cross-talk remain issues in implementing threshold voltage compensation circuits.

SUMMARY

One or more embodiments is directed to a pixel circuit including a light emitting element outputting a gray scale based on a current supplied thereto, a first transistor configured to control an amount of current supplied to the light emitting element based on a gray scale data voltage supplied to a gate electrode of the first transistor, a second transistor connected between the gate electrode of the first transistor and an initialization voltage, a third transistor connected between the gate electrode of the first transistor and a first terminal of the first transistor, a fourth transistor connected between the first terminal of the first transistor and the light emitting element, and a fifth transistor connected between a second terminal of the first transistor and a data line to which the gray scale data voltage and a power supply voltage for light emitting of the light emitting element are selectively supplied.

A first field in which the gray scale data voltage may be supplied to the data line and a second field in which the power supply voltage for light emitting of the light emitting element may be supplied to the data line are alternated in turn.

The third transistor may be controlled by a gate control signal and the fifth transistor may be controlled by a first emission control signal, such that during the first field, the third transistor and the fifth transistor are turned on in response to the gate control signal and the first emission control signal such that the gray scale data voltage is supplied to the gate electrode of the first transistor, and then, the third transistor is turned off in response to the gate control signal.

The second transistor may be controlled by a gate control signal corresponding to a previous pixel circuit and the fourth transistor may be controlled by a second emission control signal, such that during the second field, the fifth transistor and the fourth transistor are turned on in response to the first emission control signal and the second emission control signal such that the power supply voltage is supplied to the light emitting element, and before the gray scale data voltage is supplied to the gate electrode of the first transistor, the second transistor is turned on in response to the gate control signal corresponding to the previous pixel circuit, so the initialization voltage is supplied to the gate electrode of the first transistor.

One or more embodiments is directed to a method of driving a pixel circuit which includes a light emitting element outputting a gray scale based on a current supplied thereto, a first transistor configured to control an amount of current to be supplied to the light emitting element based on a gray scale data voltage supplied to a gate electrode of the first transistor; a second transistor connected between the gate electrode of the first transistor and an initialization voltage; a third transistor connected between the gate electrode of the first transistor and a first terminal of the first transistor; a fourth transistor connected between the first terminal of the first transistor and the light emitting element; and a fifth transistor connected between a second terminal of the first transistor and a data line, the method including selectively supplying the gray scale data voltage and a power supply voltage for light emitting of the light emitting element to the data line, supplying the gray scale data voltage to the gate electrode of the first transistor by turning on the third transistor and the fifth transistor, and then, turning off the third transistor, supplying the power supply voltage to the light emitting element by turning on the fifth transistor and the fourth transistor, wherein, before supplying the gray scale data voltage to the gate electrode of the first transistor, the initialization voltage is supplied to the gate electrode of the first transistor by turning on the third transistor.

The pixel circuit may have a first pixel circuit arranged at a first row and a second pixel circuit arranged at a second row, and an interval where a gray scale data voltage is supplied to the first pixel circuit and an interval where a gray scale data voltage is supplied to the second pixel circuit may overlap during at least a portion of a 1 horizontal scan period.

The method may include alternately repeating a first field in which the gray scale data voltage is supplied to the data line and a second field in which a power supply voltage for light emitting of the light emitting element is supplied to the data line.

During the first field, the initialization voltage may be supplied to the gate electrode of the first transistor.

The pixel circuit may have a first pixel circuit arranged in a first row and a second pixel circuit arranged in a second row, and supplying a voltage of the first field to one of a first data line connected to the first pixel circuit and a second data line connected to the second pixel circuit, and supplying a voltage of the second field to another of the first data line connected to the first pixel circuit and the second data line connected to the second pixel circuit.

The method may include supplying the initialization voltage to the gate electrode of the first transistor during the second field immediately following the first field in which the gray scale data voltage is supplied to the gate electrode of the first transistor.

BRIEF DESCRIPTION OF THE FIGURES

Features will become apparent to those of ordinary skill in the art by describing in detail exemplary embodiments with reference to the attached drawings in which.

DETAILED DESCRIPTION

Figure 1:
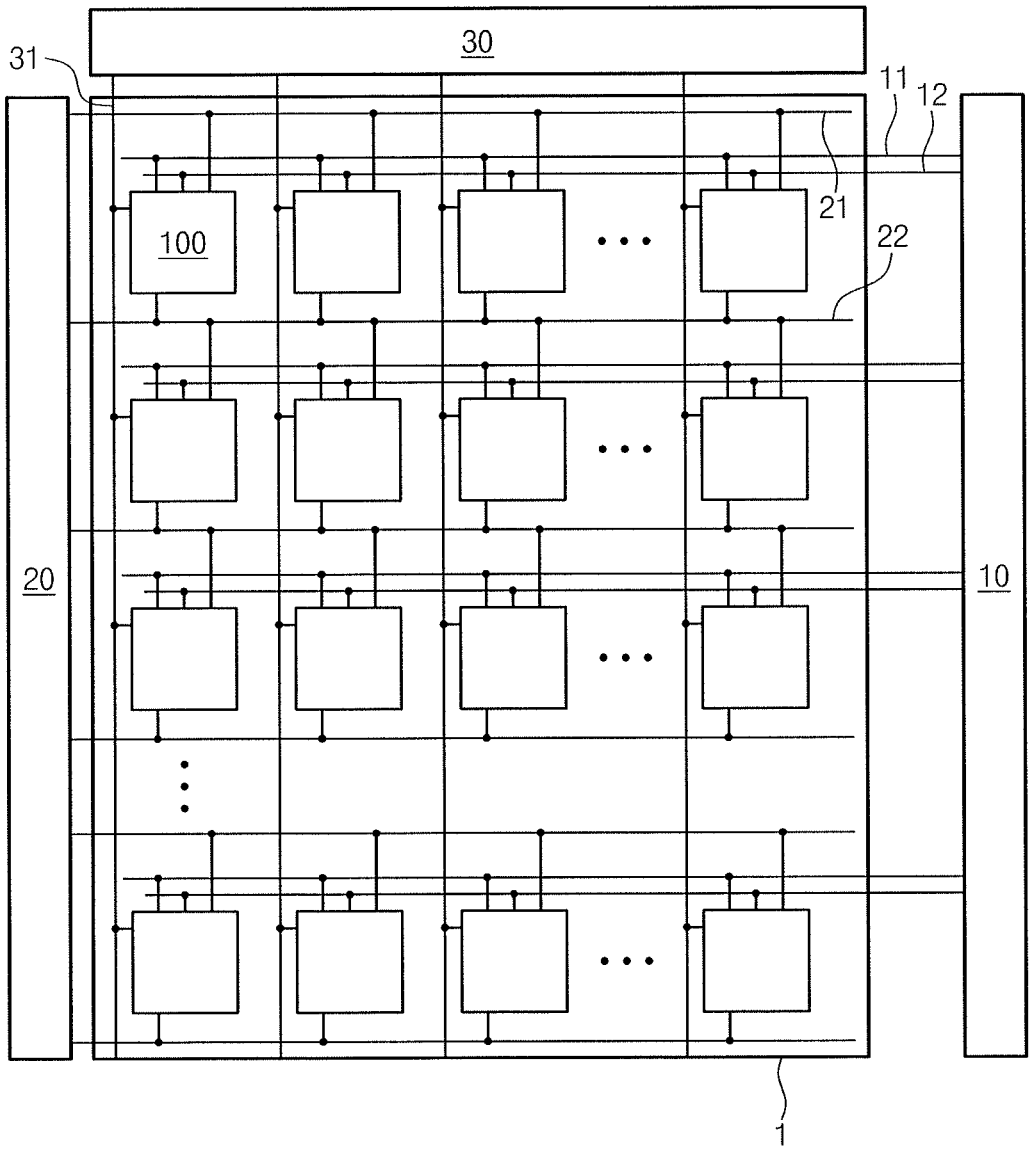
FIG. 1 illustrates a schematic diagram showing a structure of a light emitting display device according to a first embodiment.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. Like reference numerals refer to like elements throughout.

It will be understood that when an element is referred to as being "connected to", "coupled to", or "adjacent to" another element, it can be directly connected, coupled, or adjacent to the other element, or intervening elements may be present. In contrast, when an element is referred to as being "directly connected to", "directly coupled to", or "immediately adjacent to" another element or layer, there are no intervening elements present.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

Below, a pixel circuit driving a light emitting element and a display device using the same, according to embodiments will be more fully described with reference to accompanying drawings. The pixel circuit driving a light emitting element and the display device using the same may be modified or changed variously, without departing from the scope thereof, and may not be limited to embodiments to be described later. Also, in figures according to embodiments, the same portions or portions having the same function may be marked by the same reference numerals, and a duplicated description may be thus omitted.

A structure of a light emitting display device and an operating method according to a first embodiment will be more fully described with reference to FIGS. 1 to 5. FIG. 1 is a schematic diagram showing a structure of a light emitting display device according to a first embodiment. A light emitting display device includes a display panel 1, an emission driver 10, a scan driver 20, and a data driver 30. The display panel 1 includes pixel circuits 100 arranged in a matrix of n rows and m columns. The pixel circuits 100 are controlled by the emission driver 10, the scan driver 20, and the data driver 30. Here, n is 1, 2, 3 . . . , and m is 1, 2, 3 . . . . For example, n=3 designates a group of pixel circuits arranged in a third row and m=3 indicates a group of pixel circuits arranged in a third column.

The emission driver 10 is a driving circuit that controls a time at which a power supply voltage is supplied to the pixel circuits 100. The emission driver 10 supplies a first emission control signal EMa(n) and a second emission control signal EMb(n) to emission control signals 11 and 12 that correspond to each of rows of pixel circuits 100.

The scan driver 20 is a driving circuit that selects a row in which data is to be written. The scan driver 20 supplies a gate control signal Scan (n) to a gate control line 21/22 corresponding to each row of pixel circuits 100. In this embodiment, each row may be selected in a non-sequential and exclusive manner according to a predetermined order.

The data driver 30 is a driving circuit that determines a gray scale based on input image data and supplies a data voltage corresponding to the determined gray scale to the pixel circuit 100. The data driver 30 supplies a data signal DTa(m) to a data signal line 31 corresponding to each of columns of pixel circuits 100. The data signal DTa(m) may include a gray scale data voltage Vdata(m) of a pixel and an anode power ELVDD for supplying a current to a light emitting element, which are converted through a conversion circuit included in the data driver 30.

Figure 2:
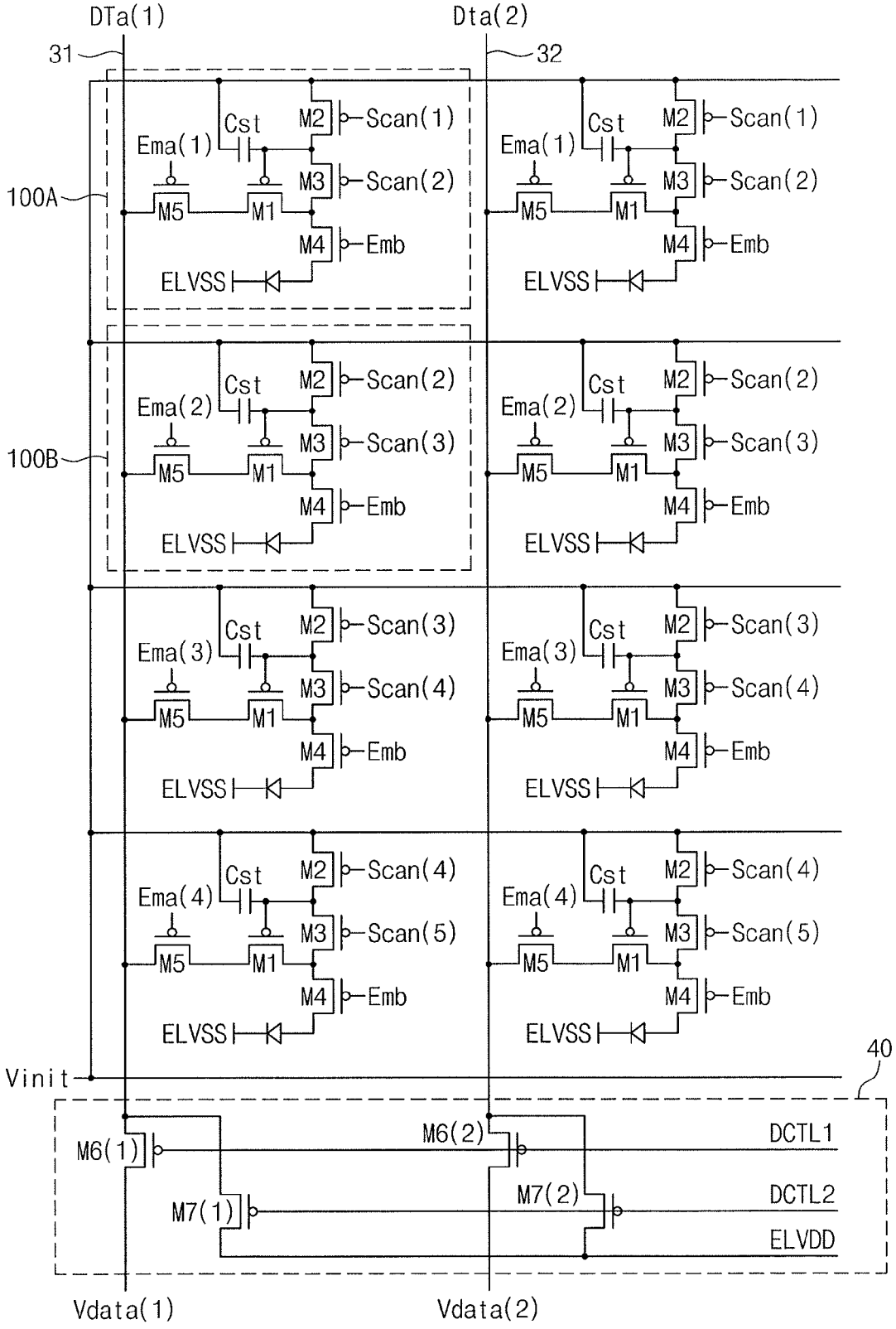
FIG. 2 illustrates a circuit diagram showing a pixel circuit and a conversion circuit included in a data driver.

FIG. 2 is a circuit diagram of a pixel circuit 100 and a conversion circuit 40 included in a data driver 30. FIG. 2 shows an example in which all transistors forming a pixel circuit are p-type.

A connection between a gate control signal Scan(n) and each pixel circuit will be described with reference to FIG. 2. Referring to a pixel circuit 100A at a first column (m=1) and a first row (n=1) and a pixel circuit 100B at the first column (m=1) and a second row (n=2), a switch transistor M3 of the pixel circuit 100A and a switch transistor M2 in the second row are controlled at the same time, e.g., using a same signal. A circuit operation will be more fully described later. If a circuit is configured as described above, a threshold voltage compensation operation of the pixel circuit 100A and an initialization operation of the pixel circuit 100B are simultaneously performed. Therefore, gray scale data is written such that efficiency is improved in a non-emission interval of a light emitting element.

The conversion circuit 40 will be described with reference to FIG. 2. The conversion circuit 40 receives the gray scale data voltage Vdata(m) and the anode voltage ELVDD, and is controlled by first and second gate control signals DCTL1 and DCTL2. For example, when transistors M6(1) and M6(2) are turned on by a first gate control signal DCTL1, the gray scale data voltage Vdata(m) is supplied to pixel circuits 100A and 100B. When transistors M7(1) and M7(2) are turned on by a second gate control signal DCTL2, the anode voltage ELVDD is supplied to a pixel circuit.

Figure 3:
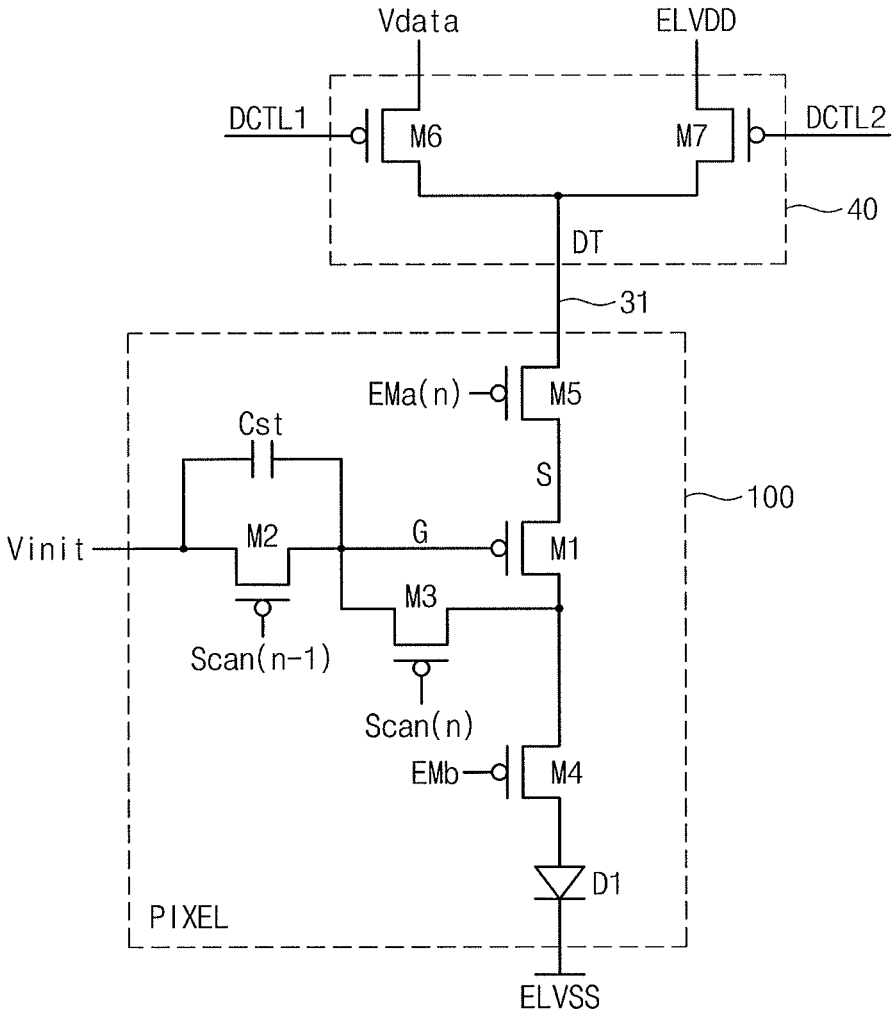
FIG. 3 illustrates a circuit diagram schematically illustrating a pixel circuit according to an embodiment.

FIG. 3 is a circuit diagram schematically illustrating the pixel circuit 100 according to an embodiment. In FIG. 3, all transistors forming a pixel circuit are p-type. The pixel circuit 100 may include a driving transistor M1, switch transistors M2 and M3, emission transistors M4 and M5, a capacitor Cst, and a light emission element D1. The light emission element D1 may be formed of a diode and a parasitic capacitance. As understood from the above description, the pixel circuit 100 is made up of five transistors M1 to M5 and a capacitor Cst.

A connection between elements of the pixel circuit 100 will be described with reference to FIG. 3.

Referring to FIG. 3, a cathode electrode of the light emitting element D1 is connected to a cathode voltage ELVSS. The driving transistor M1 controls the amount of current to be supplied to the light emitting element D1 according to a voltage supplied to its gate electrode. The gate electrode of the light emitting element D1 is connected to an initialization voltage Vinit through the switch transistor M2. The switch transistor M3 is connected between the gate electrode of the driving transistor M1 and one of source and drain electrodes thereof. The gate electrode of the driving transistor M1 is connected to a first electrode of the capacitor Cst retaining gray scale data and a second electrode of the capacitor Cst is connected to the initialization voltage Vinit. The emission transistor M4 is connected between one of the source and drain electrodes of the driving transistor M1 and an anode electrode of the light emitting element D1. The other of the source and drain electrodes of the driving transistor M1 is connected to a data line 31 through the emission transistor M5.

Figure 5:
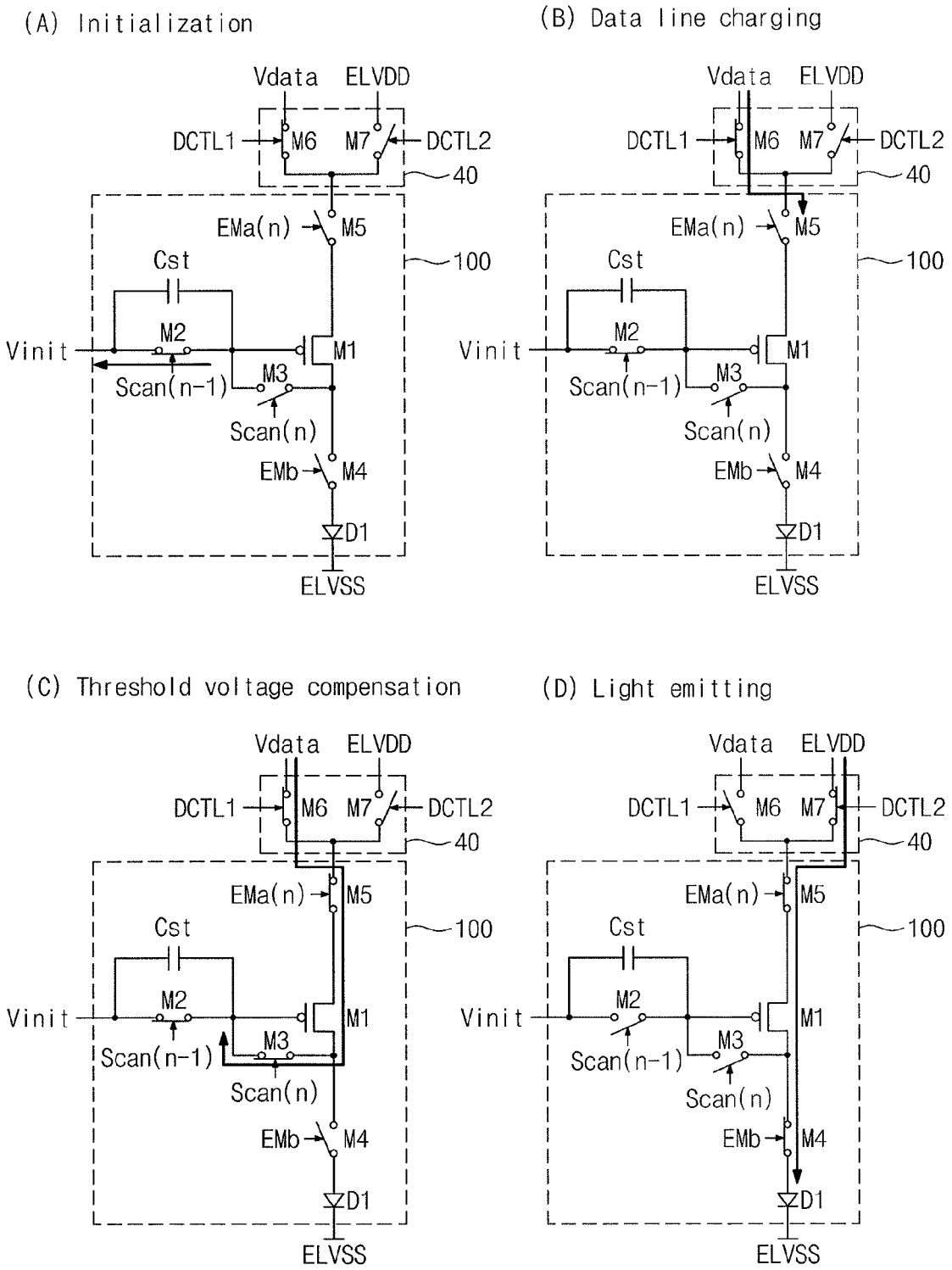
FIG. 5 illustrates a diagram showing operations of a pixel circuit shown in FIG. 3.
Figure 6:
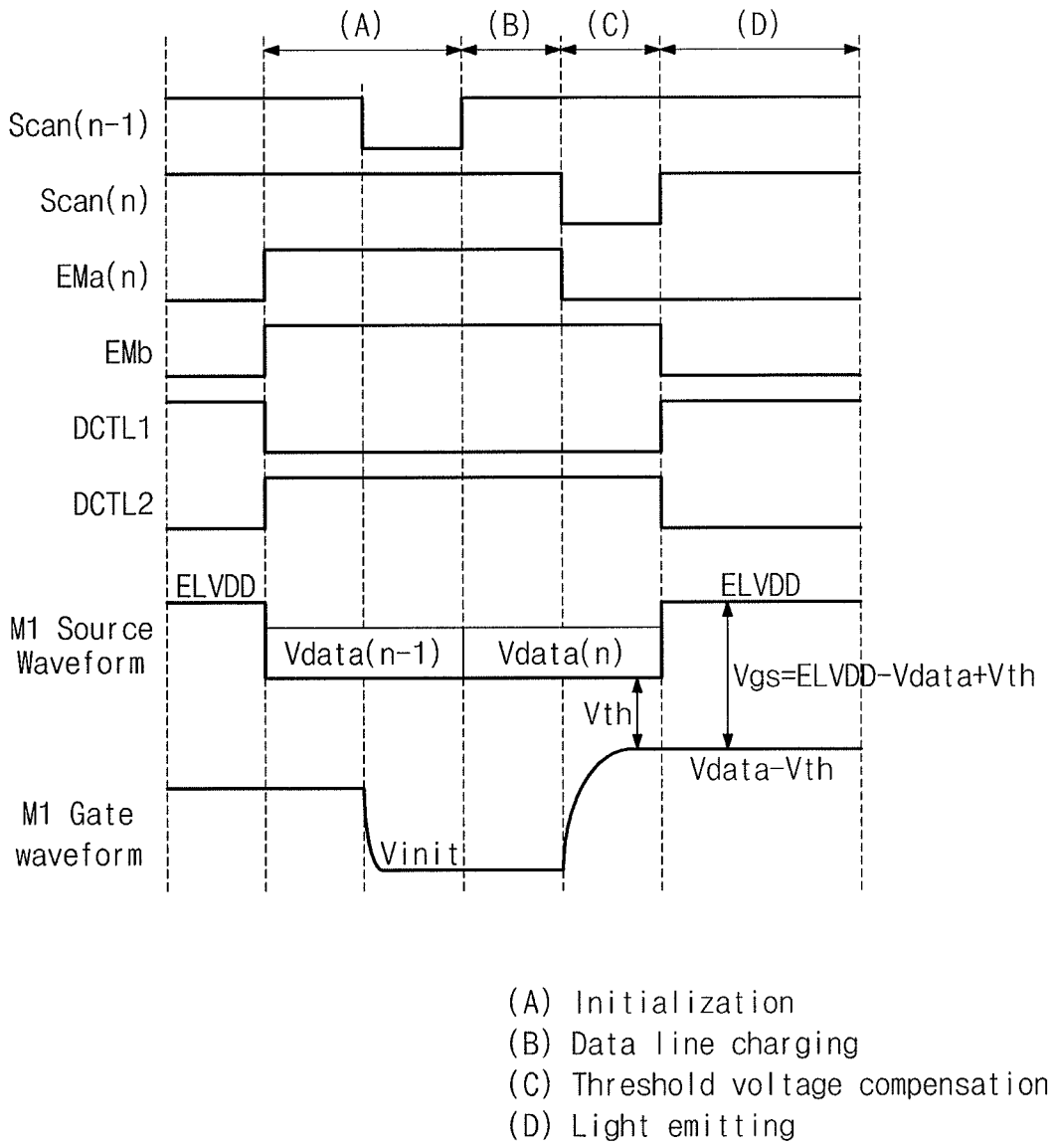
FIG. 6 illustrates a timing diagram showing signals used when a pixel circuit shown in FIG. 5 operates.

FIG. 5 is a diagram showing operations of a pixel circuit shown in FIG. 3. FIG. 6 is a timing diagram showing signals used when a pixel circuit shown in FIG. 5 operates. In FIGS. 5 and 6, (A), (B), (C), and (D) indicate an initialization interval, a data line charging interval, a threshold voltage compensation interval, and a light emitting interval, respectively. Intervals shown in FIGS. 5 and 6 may be substantially the same. A timing diagram shown in FIG. 6 represents potentials of nodes, an M1 source waveform corresponds to a potential of the source electrode of the M1 transistor shown in FIG. 5, and an M1 gate waveform corresponds to a potential of a gate electrode of the M1 transistor shown in FIG. 5.

Initialization Interval

When the switch transistor M2 is turned on in response to a high-to-low transition of a gate control signal Scan(n−1), the gate electrode of the driving transistor M1 is connected to the initialization voltage Vinit. Thus, the pixel circuit 100 is reset. At this time, the first gate control signal DCTL1 of the conversion circuit 40 goes to a low level, the second gate control signal DCTL2 goes to a high level, and the gray scale data voltage Vdata(m) is supplied to a data line. When the gate control signal Scan(n−1) has a low-to-high transition, the switch transistor M2 is turned off. That is, initialization on the pixel circuit 100 is terminated.

Data Line Charging Interval

When the gray scale data voltage Vdata(m) of the pixel circuit 100 is supplied to a data line under such a condition that the first gate control signal DCTL1 of the conversion circuit 40 has a low level and the second gate control signal DCTL2 has a high level, a source potential of the driving transistor M1 is stabilized with the gray scale data voltage Vdata(m).

Threshold Voltage Compensation Interval

As the gate control signal Scan(n) and a first emission control signal EMa(n) transition to a low level, the switch transistor M3 and the emission transistor M5 of the pixel circuit 100 are turned on. The gray scale data voltage Vdata supplied to the data line is transferred to a gate electrode of the transistor M1 through the transistor M5, the transistor M1, and the transistor M3. At this time, since the gate electrode of the driving transistor M1 is connected to one of a source electrode and a drain electrode thereof, the switch transistor M3 is diode-connected. A voltage lower by a threshold voltage of the transistor M1 than the gray scale data voltage Vdata is supplied to the gate electrode of the transistor M1. This operation is referred to as a threshold voltage compensation operation. With the threshold voltage compensation operation, influence due to a variation in a threshold voltage of the driving transistor M1 may be suppressed and a current flowing from a data line 31 to a light emitting element D1 more be accurately controlled. Afterwards, the transistor M3 of the pixel circuit 100 is turned off in response to a low-to-high transition of the gate control signal Scan(n). That is, the threshold voltage compensation operation is ended.

Light Emitting Interval

When the first gate control signal DCTL1 of the conversion circuit 40 transitions to a high level and the second gate control signal DCTL2 transitions to a low level, an anode voltage ELVDD is supplied to the light emitting element D1 through the transistor M5, the transistor M1, and the transistor M4. That is, the light emitting element D1 emits light.

Figure 4:
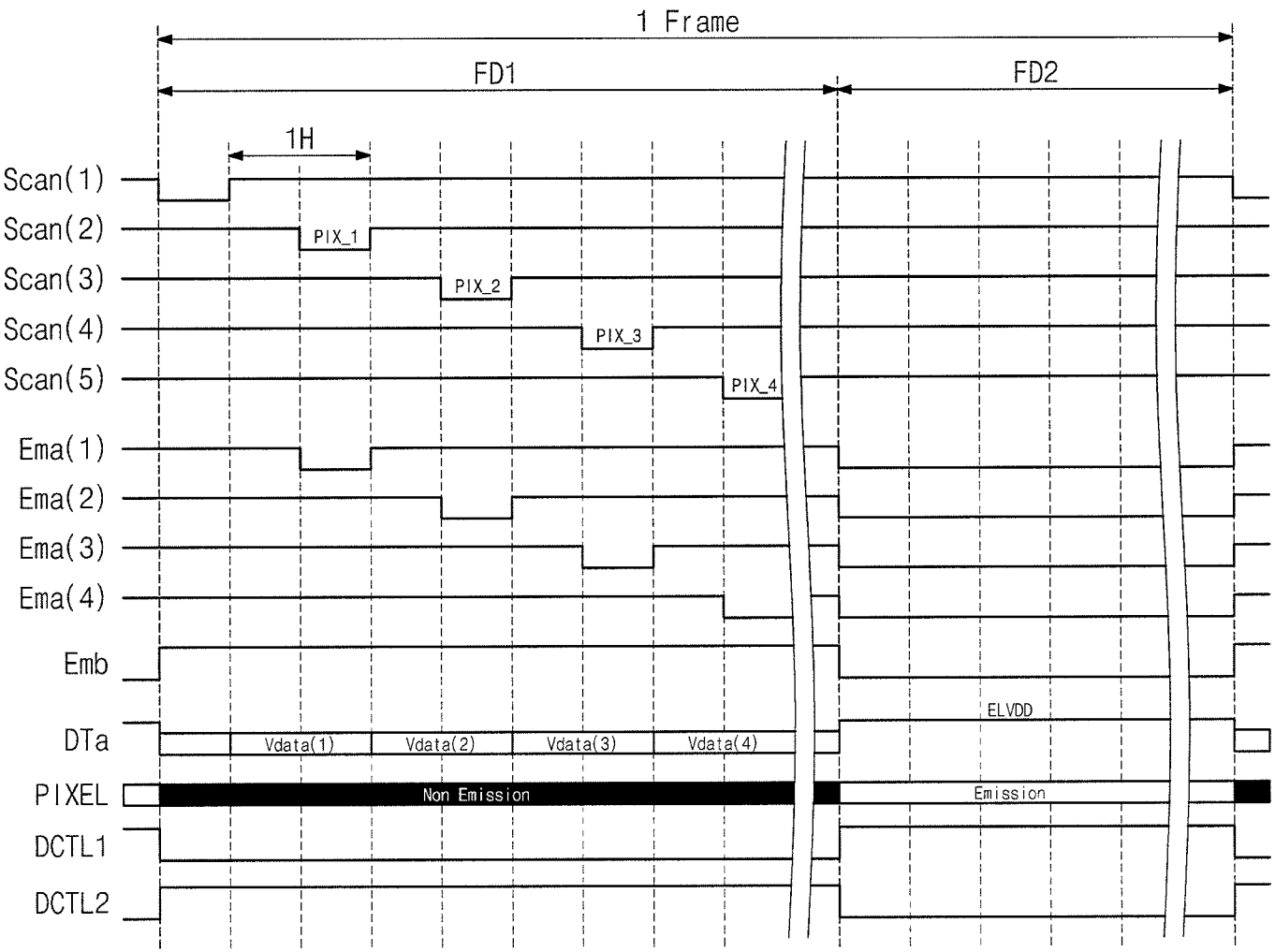
FIG. 4 illustrates a timing diagram for describing an operation of a circuit shown in FIG. 2.

FIG. 4 is a timing diagram for describing an operation of a circuit shown in FIG. 2. An operation of pixel circuits will be described with reference to FIGS. 2 and 4.

Below, it is assumed that a variety of signals for operating a pixel circuit are voltage signals each indicating a logical level of a "low level" or a "high level". Also, that a transistor conducts will be described using expression: "a transistor is turned on". Further, that a transistor does not conduct will be described using expression: "a transistor is turned off".

As shown in FIG. 4, a first frame period in which data is written to all pixel circuits of a display panel and light emission is performed is divided into a first field FD1 and a second field FD2. Here, the first field FD1 is defined as a gray scale data writing interval (or, a non-light emitting interval), and the second field FD2 is defined as a light emitting interval. During the first field FD1 where a first gate control signal DCTL1 of a conversion circuit has a low level and a second gate control signal DCTL2 has a high level, transistors M6(1) and M6(2) are turned on, and transistors M7(1) and M7(2) are turned off. At this time, a gray scale data voltage Vdata(m) is supplied as a data signal DTa. Meanwhile, during the second field FD2, the first gate control signal DCTL1 of the conversion circuit has a high level, and the second gate control signal DCTL2 has a low level. With this condition, the transistors M6(1) and M6(2) are turned off, and the transistors M7(1) and M7(2) are turned on. At this time, an anode voltage ELVDD is supplied as the data signal DTa.

Operations of a pixel circuit 100A at a first column and a first row and a pixel circuit 100B at the first column and a second row will be described with reference to FIG. 4. During the first field FD1, initialization is performed by setting a gate control signal Scan(1) to a low level and turning on a transistor M2 of the pixel circuit 100A. At this time, the pixel circuit 100A may correspond to an initialization interval (A). Next, the pixel circuit 100A becomes off by setting the gate control signal Scan(1) to a high level. That is, initialization is terminated.

Then, a data line 31 is charged by supplying a gray scale data voltage Vdata(1) as a data signal DTa(1). At this time, the pixel circuit 100A may correspond to a data line charging interval (B).

After that, a gate control signal Scan(2) and a first emission control signal EMa(1) are simultaneously set to a low level, so a transistor M3 of the pixel circuit 100A is turned on. That is, a threshold voltage compensation operation is performed. Also, during the same interval, a switch transistor M2 of the pixel circuit 100B at the first column and the second row is turned on, and the pixel circuit 100B is reset. At this time, the pixel circuit 100A may correspond to a threshold voltage compensation interval (C), and the pixel circuit 100B may correspond to the initialization interval (A).

Finally, as a gate control signal Scan(2) and the first emission control signal EMa(1) set to a high level, the transistor M3 of the pixel circuit 100A is turned off. At this time, a threshold voltage compensation operation is ended. Also, in the same interval, initialization is ended by turning off a switch transistor M2 of the pixel circuit 100B. An operation following the initialization operation of the pixel circuit 100B is substantially the same as that of the pixel circuit 100A, and a description thereof is thus omitted.

As described above, pixel circuits 100A and 100B (refer to FIG. 2) of the display panel 1 (refer to FIG. 1) sequentially perform an initialization operation, a data line charging operation, and a threshold voltage compensation operation. If a gray scale data signal is written to all the pixel circuits 100A and 100B, switching from the first field FD1 to the second field FD2 is made. A light emitting element D1 emits a light when an anode voltage ELVDD is supplied to each pixel circuit 100 through data lines 31 and 32. At this time, the pixel circuits 100A and 100B may correspond to a light emitting interval (D). In exemplary embodiments, gray scale data is written to each pixel circuit in the first field FD1, and a simultaneous driving operation for simultaneous light emitting is performed in the second field FD2.

Figure 7:
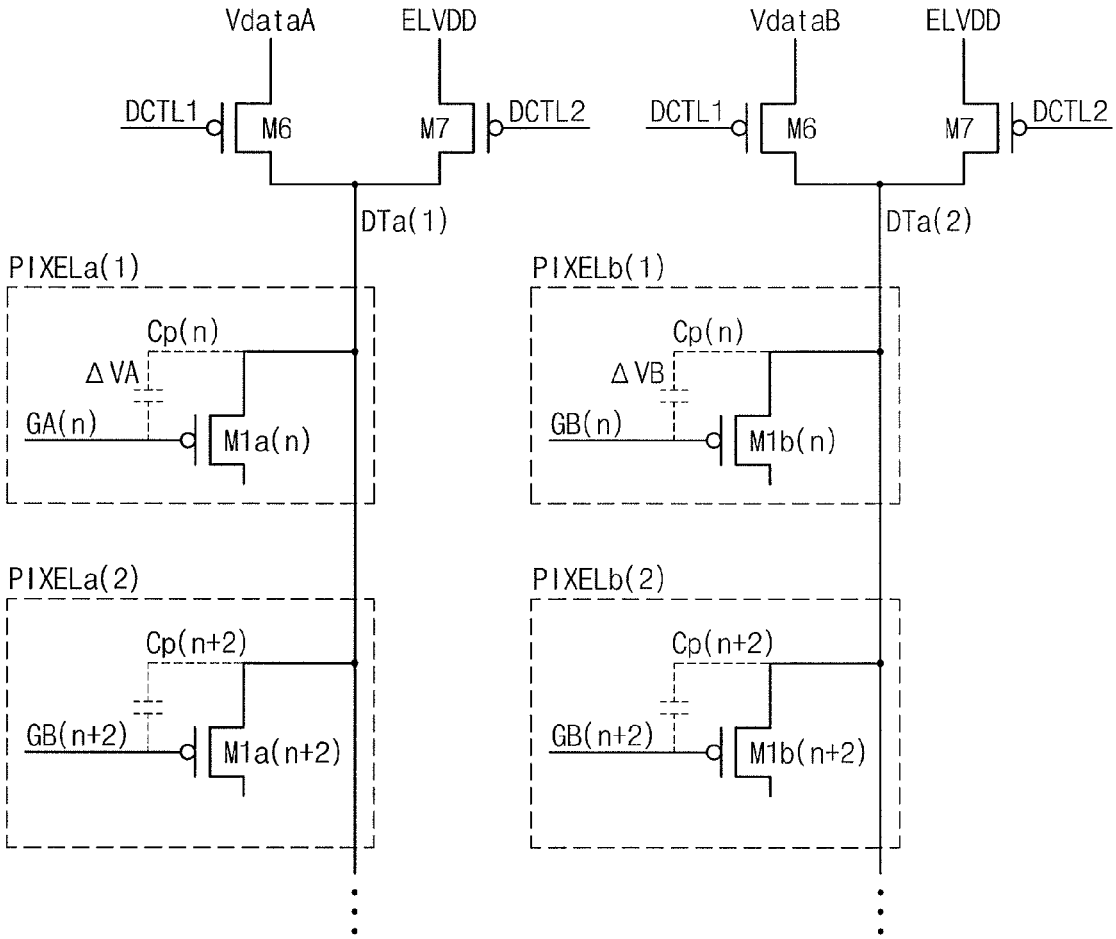
FIG. 7 illustrates a circuit diagram of a comparative example where a driving transistor is directly connected to a data line.

Below, the effects of embodiments will be described with reference to a comparative example. FIG. 7 is a circuit diagram schematically illustrating a comparative example where a driving transistor is directly connected to a data line. A pixel circuit shown in FIG. 7 includes four transistors and a capacitor. In this pixel circuit, a driving transistor of each pixel may be directly connected to a data line.

If a driving transistor M1a(n) is directly connected to a data line as shown in FIG. 7, a crosstalk is generated due to a parasitic capacitance Cp(n) formed between a source/drain electrode and a gate electrode of the driving transistor M1a (n), thereby lowering the quality of display.

Figure 8:
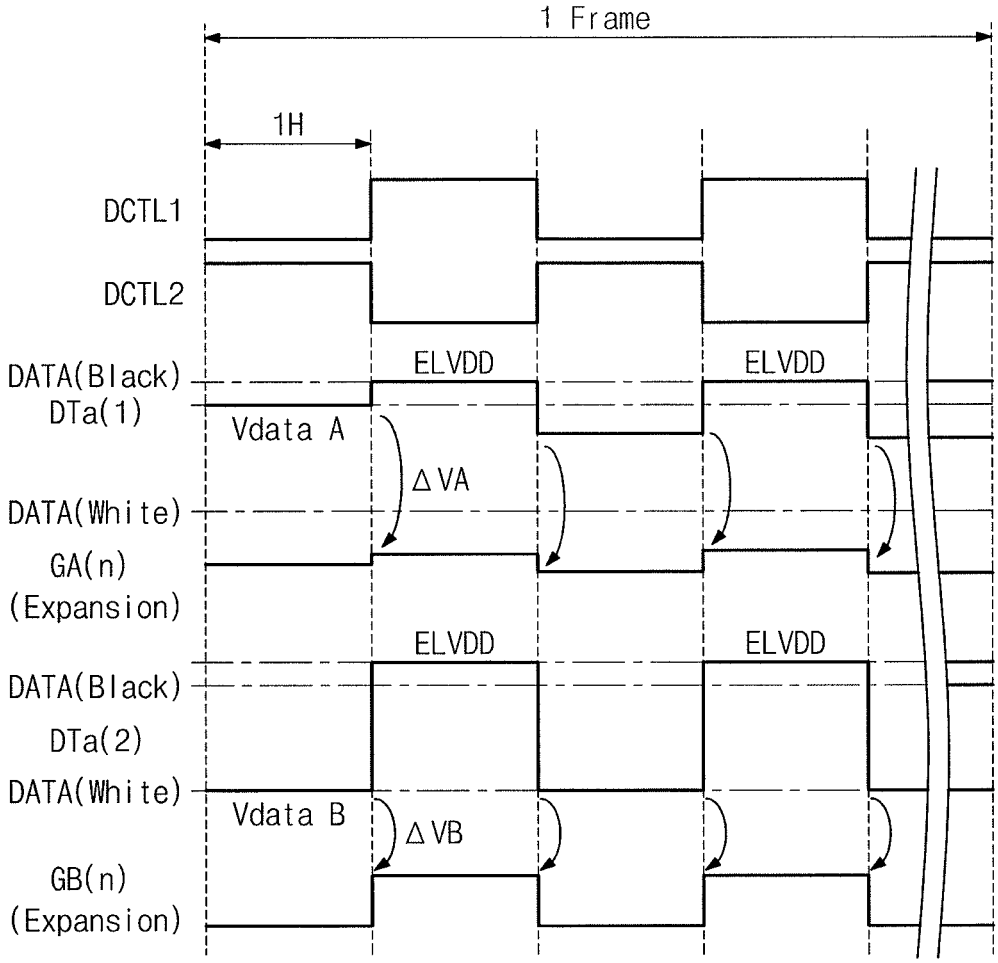
FIG. 8 illustrates an example where writing of data at other pixel circuits connected with data lines on the same line and light emitting are performed in turn.

A detailed crosstalk phenomenon is shown in FIG. 8. FIG. 8 shows an example where writing of data at other pixel circuits connected with data lines DTa(1) and DTa(2) on the same line and light emitting are performed in turn. Alternating switching is performed between a gray scale data voltage VdataA/VdataB and an anode voltage ELVDD every one horizontal scan interval (1H). This example shows a gate potential GA(n) of a driving transistor M1a(n) of a pixel circuit PIXELa(1) and a gate potential GB(n) of a driving transistor M1b(n) of a pixel circuit PIXELb(1) in the event that the amplitude of the gray scale data voltage VdataA is larger than that of the gray scale data voltage VdataB. The gate potentials GA(n) and GB(n) are fluctuated due to influence of the parasitic capacitance CP(n). Influence on a gate electrode of a transistor M1a(n) connected increases in proportion to an increase in the amplitude of a data voltage. A potential variation of the gate electrode of the transistor M1a (n) causes a variation in brightness, thereby resulting in a crosstalk.

Meanwhile, in the first embodiment in which an emission transistor is connected between a driving transistor M1 (refer to FIG. 4) and a data line, the driving transistor M1 is not influenced by a voltage variation of a data signal supplied to a data line, and the image quality is improved through suppression of a crosstalk.

Figure 9:
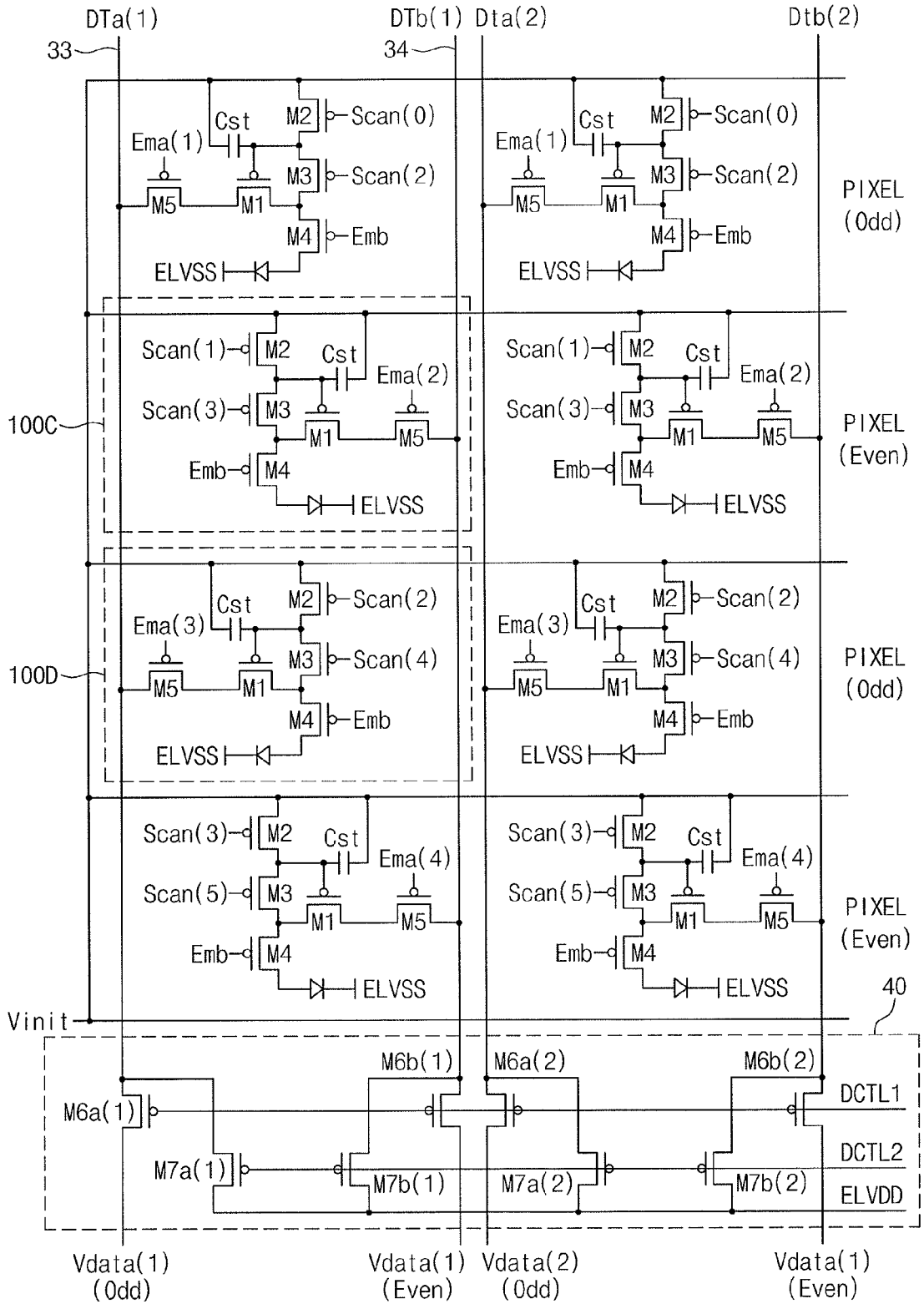
FIG. 9 illustrates a circuit diagram of a light emitting display device according to a second embodiment.

A structure and an operating method of a light emitting display device according to a second embodiment will be described with reference to FIGS. 9 and 10. FIG. 9 is a circuit diagram schematically illustrating a light emitting display device according to a second embodiment. The second embodiment is different from a first embodiment in that two data lines 31 and 32 exist, an odd-numbered row of pixel circuits is connected to the data line 31, and an oven-numbered row of pixel circuit is connected to the data line 32. A conversion circuit is also configured to supply signals that are independent from a data signal to be supplied to the odd-numbered row of pixel circuits and from a data signal to be supplied to the even-numbered row of pixel circuits.

Figure 10:
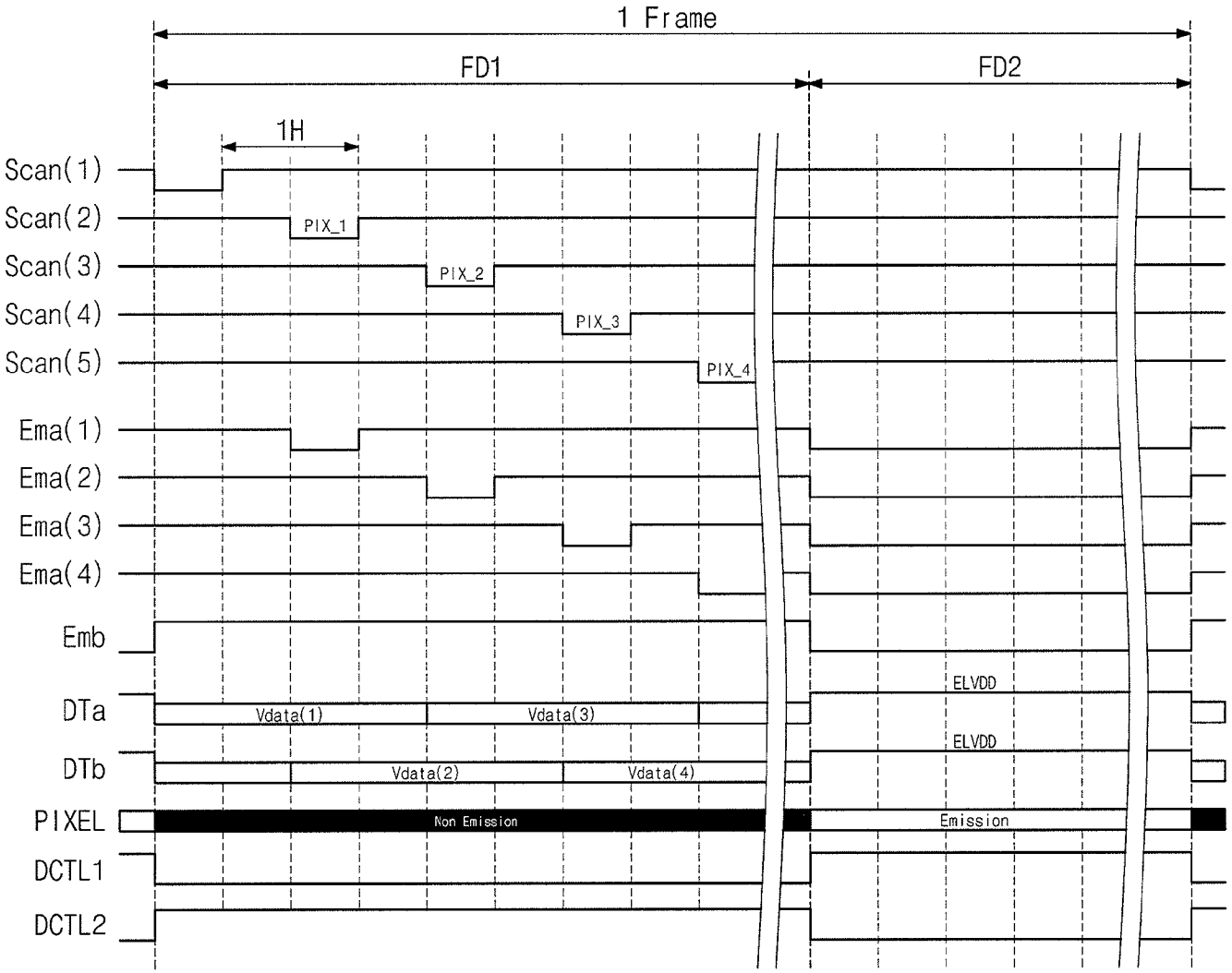
FIG. 10 illustrates a timing diagram for describing an operation of a circuit shown in FIG. 9.

FIG. 10 is a timing diagram for describing an operation of a circuit shown in FIG. 9. Like a first embodiment shown in FIGS. 2 and 4, a first frame period is divided into a first field FD1 and a second field FD2. During the first field FD1, a first gate control signal DCTL1 of the conversion circuit has a low level, and a second gate control signal DCTL2 thereof has a high level. With this condition, a gray scale data signal Vdata is supplied to data lines DTa and DTb. Meanwhile, during the second field FD2, the first gate control signal DCTL1 of the conversion circuit has a high level, and the second gate control signal DCTL2 thereof has a low level. With this condition, an anode voltage ELVDD is supplied to the data lines DTa and DTb.

Below, operations of a pixel circuit 100C at a first column and a second row and a pixel circuit 100D at the first column and a third row will be described with reference to a timing diagram shown in FIG. 10. First, during a first field FD1, the pixel circuit 100C is reset by setting a gate control signal Scan(1) to a low level. At this time, the pixel circuit 100C may correspond to an initialization interval (A).

Next, the pixel circuit 100D is reset by setting a gate control signal Scan(2) to a low level. During the same interval, also, a gray scale data voltage Vdata(2) is supplied to a data line DTb to charge a data line 34. At this time, the pixel circuit 100C may correspond to a data line charging interval (B), and the pixel circuit 100D may correspond to the initialization interval (A).

Then, a threshold voltage compensation operation of the pixel circuit 100C is performed by setting a gate control signal Scan(3) and a first emission control signal EMa(2) to a low level. During the same interval, also, a gray scale data voltage Vdata(3) is provided to a data line DTa to charge a data line 33. At this time, the pixel circuit 100C may correspond to a threshold voltage compensation interval (C), and the pixel circuit 100D may correspond to the data line charging interval (B). Afterward, the threshold voltage compensation operation of the pixel circuit 100C is ended by setting the gate control signal Scan(3) and the first emission control signal EMa(2) to a high level.

After that, the threshold voltage compensation operation of the pixel circuit 100D is performed by setting the gate control signal Scan(4) and the first emission control signal EMa(3) to a low level. At this time, the pixel circuit 100D may correspond to the threshold voltage compensation interval (C). Afterward, the threshold voltage compensation operation of the pixel circuit 100D is ended by setting the gate control signal Scan(4) and the first emission control signal EMa(3) to a high level.

As described above, an initialization operation, a data line charging operation, and a threshold voltage compensation operation about pixel circuits in a panel are performed in a line-sequential manner. If gray scale data is written to all pixel circuits of the panel, switching from the first field FD1 to the second field FD2 is made, and light emitting elements emit light when the anode voltage ELVDD is supplied to pixels through the data lines 33 and 34. At this time, each of the pixel circuits 100C and 100D may correspond to a light emitting interval. In exemplary embodiments, gray scale data is written to each pixel circuit in the first field FD1, and a simultaneous driving operation for simultaneous light emitting is performed in the second field FD2.

With the second embodiment shown in FIGS. 9 and 10, gray scaly data corresponding to an even-numbered row and gray scaly data corresponding to an odd-numbered row are supplied to overlap within an interval. For example, a threshold voltage compensation operation about an odd-numbered row of pixel circuits is performed while charging data lines corresponding to an even-numbered row. Since a charging interval of the first embodiment corresponds to a threshold voltage compensation operation, it is possible to implement double a threshold voltage compensation interval with the same duty ratio. In the second embodiment, the output intervals of two data signals always overlap. However, embodiments are not limited thereto. For example, output intervals of two data signals may partially overlap.

Figure 11:
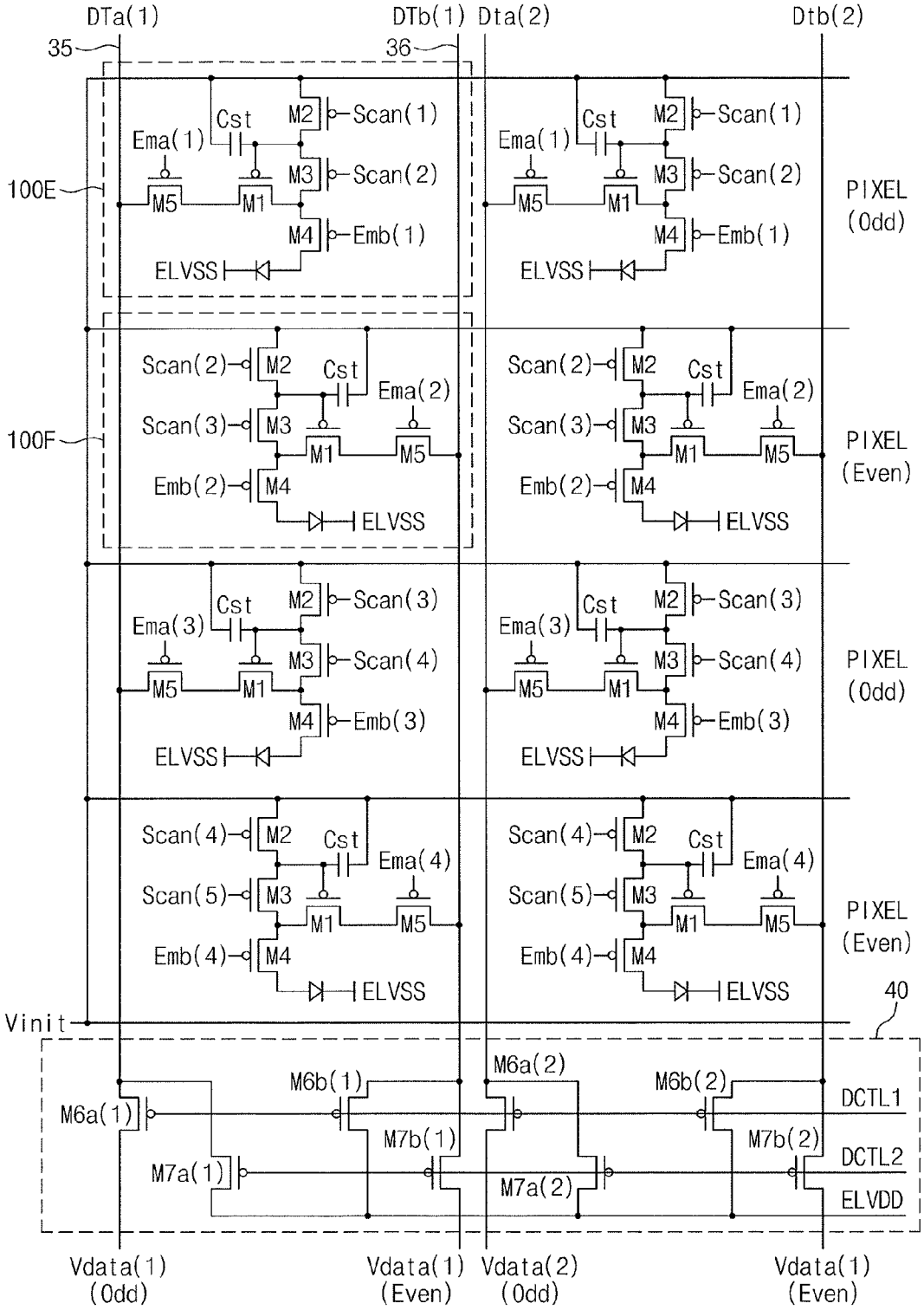
FIG. 11 illustrates a circuit diagram of a light emitting display device according to a third embodiment.

A structure and an operating method of a light emitting display device according to a third embodiment will be more fully described with reference to FIGS. 11 and 12. FIG. 11 is a circuit diagram schematically illustrating a light emitting display device according to a third embodiment. In FIG. 11, a connection between a switch transistor M2 and an emission transistor M4 is different from that according to a second embodiment.

Figure 12:
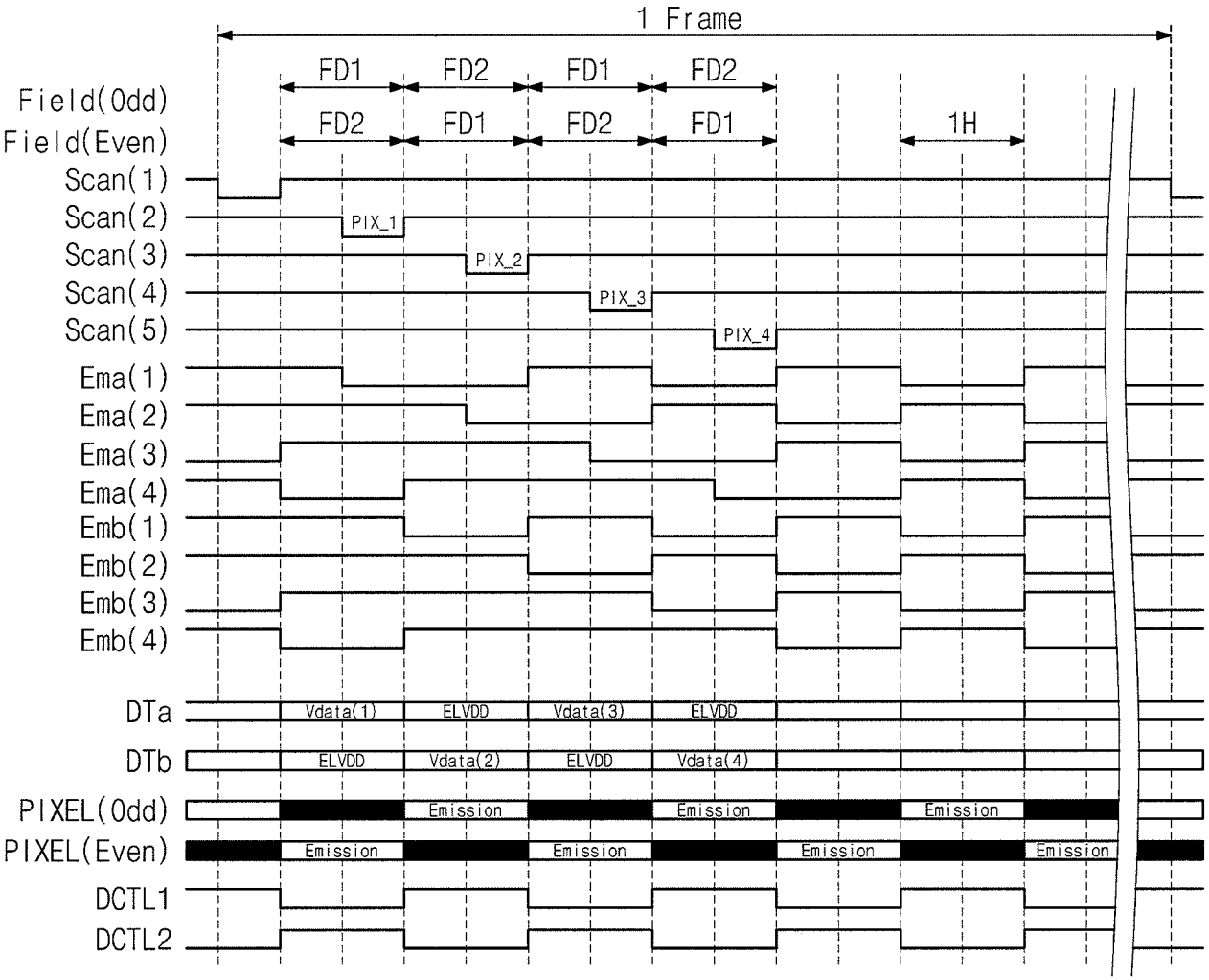
FIG. 12 illustrates a timing diagram for describing an operation of a circuit shown in FIG. 11.

FIG. 12 is a timing diagram for describing an operation of a circuit shown in FIG. 11. Unlike first and second embodiments, each of 1 horizontal scan intervals 1H is broken down into a first field FD1 and a second field FD2. During a first field FD1 shown in FIG. 12, a first gate control signal DCTL1 of a conversion circuit is set to a low level, and a second gate control signal DCTL2 thereof is set to a high level. With this condition, a gray scale data voltage Vdata is supplied to a data line DTa, and an anode voltage ELVDD is supplied to a data line DTb. At this time, gray scale data is written to a first row of pixel circuits, and other odd-numbered rows of pixel circuits are set to a non-emission interval. An odd-numbered row may correspond to a first field FD1. Also, even-numbered rows of pixel circuits all are set to an emission interval and may correspond to a second field FD2. Next, during a second field FD2 shown in FIG. 12, the first gate control signal DCTL1 of the conversion circuit is set to a high level, and the second gate control signal DCTL2 thereof is set to a low level. With this condition, the anode voltage ELVDD is supplied to the data line DTa, and the gray scale data voltage Vdata is supplied to the data line DTb. Alternatively, an odd-numbered row may correspond to the first field FD2, and an even-numbered row may correspond to the first field FD1.

Below, operations of a pixel circuit 100E at a first column and a first row and a pixel circuit 100F at the first column and a second row will be described with reference to a timing diagram shown in FIG. 12. In this circuit, first, gray scale data is written to an odd-numbered row of pixel circuits (first field FD1), and an even-numbered row of pixel circuits emit light (second field FD2). Next, gray scale data is written to an even-numbered row of pixel circuits (first field FD1), and an odd-numbered row of pixel circuits emit light (second field FD2). During a 1 horizontal scan interval 1H immediately before gray scale data is written, light emitting is inhibited to reset pixel circuits.

First, in the pixel circuit 100E, a gate control signal Scan(1) is set to a low level during the second field FD2 immediately before gray scale data is written, and the pixel circuit 100E is reset. At this time, the pixel circuit 100E may correspond to an initialization interval. As a first emission control signal EMa (1) and a second emission control signal EMb are set to a high level, the pixel circuit 100E does not emit light, and other odd-numbered rows of pixel circuits emit light.

Next, the pixel circuit 100E goes to the first field FD1, a gray scale data voltage Vdata(1) is supplied to a data line DTa, and a data line 35 is charged. At this time, the pixel circuit 100E may correspond to a data line charging interval.

Then, a threshold voltage compensation operation of the pixel circuit 100E is performed by setting a gate control signal Scan(2) and a first emission control signal EMa(1) to a low level (the pixel circuit 100E corresponding to the first field FD1). During the same interval, also, a pixel circuit 100F may be reset (the pixel circuit 100F corresponding to the second field FD2). At this time, the pixel circuit 100F may correspond to an initialization interval (A). Afterward, the threshold voltage compensation operation of the pixel circuit 100E is ended by setting the gate control signal Scan(2) to a high level.

After that, the pixel circuit 100E goes to the second field FD2, an anode voltage ELVDD is supplied to the pixel circuit 100E through a data line 35 by setting a second emission control signal EMb(1) to a low level, with a first emission control signal EMa(1) set to a low level. That is, a light emitting element emits light. During this interval, charging of a data line 36 and a threshold voltage compensation operation are performed in the pixel circuit 100F (the pixel circuit 100F corresponding to the first field FD1). At this time, the pixel circuit 100E may correspond to a light emitting interval (D), and the pixel circuit 100F may correspond to a data line charging interval (B) and a threshold voltage compensation interval (C). Such operations are the same as those of the pixel circuit 100E, and a description thereof is thus omitted. In a following field, a light emitting element of the pixel circuit 100E does not emit light (FD1), and a light emitting element of the pixel circuit 100F emits light (FD2). At this time, the pixel circuit 100F may correspond to the light emitting interval (D).

As described above, the first field FD1 and the second field FD2 are repeated, and light emitting and non-light emitting are switched within one frame. In exemplary embodiments, during one field, gray scale data is written to an odd-numbered row of pixel circuits and an even-numbered row of pixel circuits emit light. During a next field, gray scale data is written to an even-numbered row of pixel circuits and an odd-numbered row of pixel circuits emit light. That is, a progressive driving method where pixel circuits in either an even-numbered row or an odd-numbered row emit light is used.

With the third embodiment, since light emitting and non-light emitting are repeated within a 1 horizontal scan period 1H as compared with other embodiments, screen flicker is not generated, and high quality images are obtained.

Figure 13:
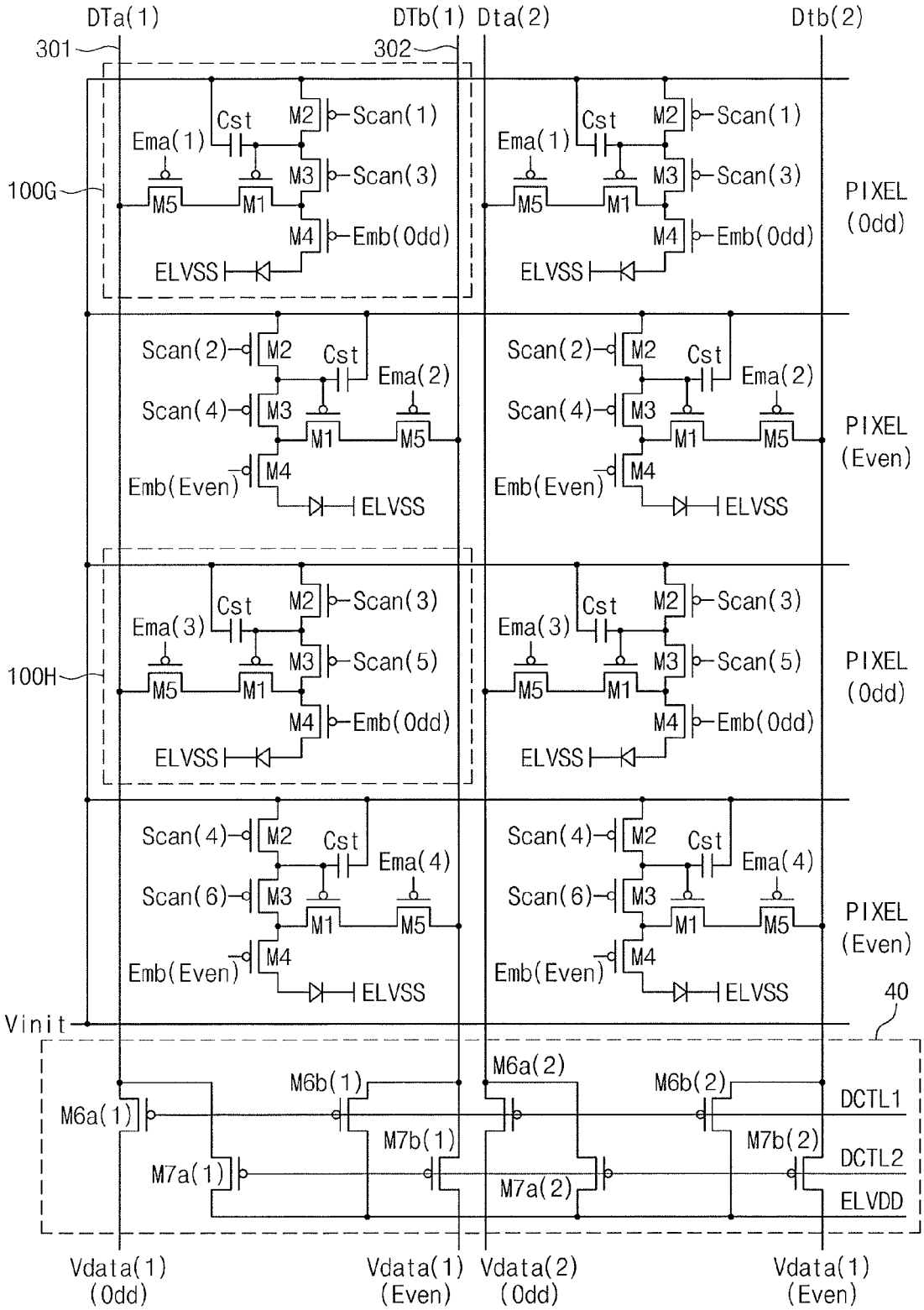
FIG. 13 illustrates a circuit diagram of a light emitting display device according to a fourth embodiment.

Below, a structure and an operating method of a light emitting display device will be more fully described with reference to FIGS. 13 and 14. FIG. 13 is a circuit diagram schematically illustrating a light emitting display device according to a fourth embodiment. A fourth embodiment is different from a third embodiment in that an emission transistor M4 is connected every odd-numbered row and every even-numbered TOW.

Figure 14:
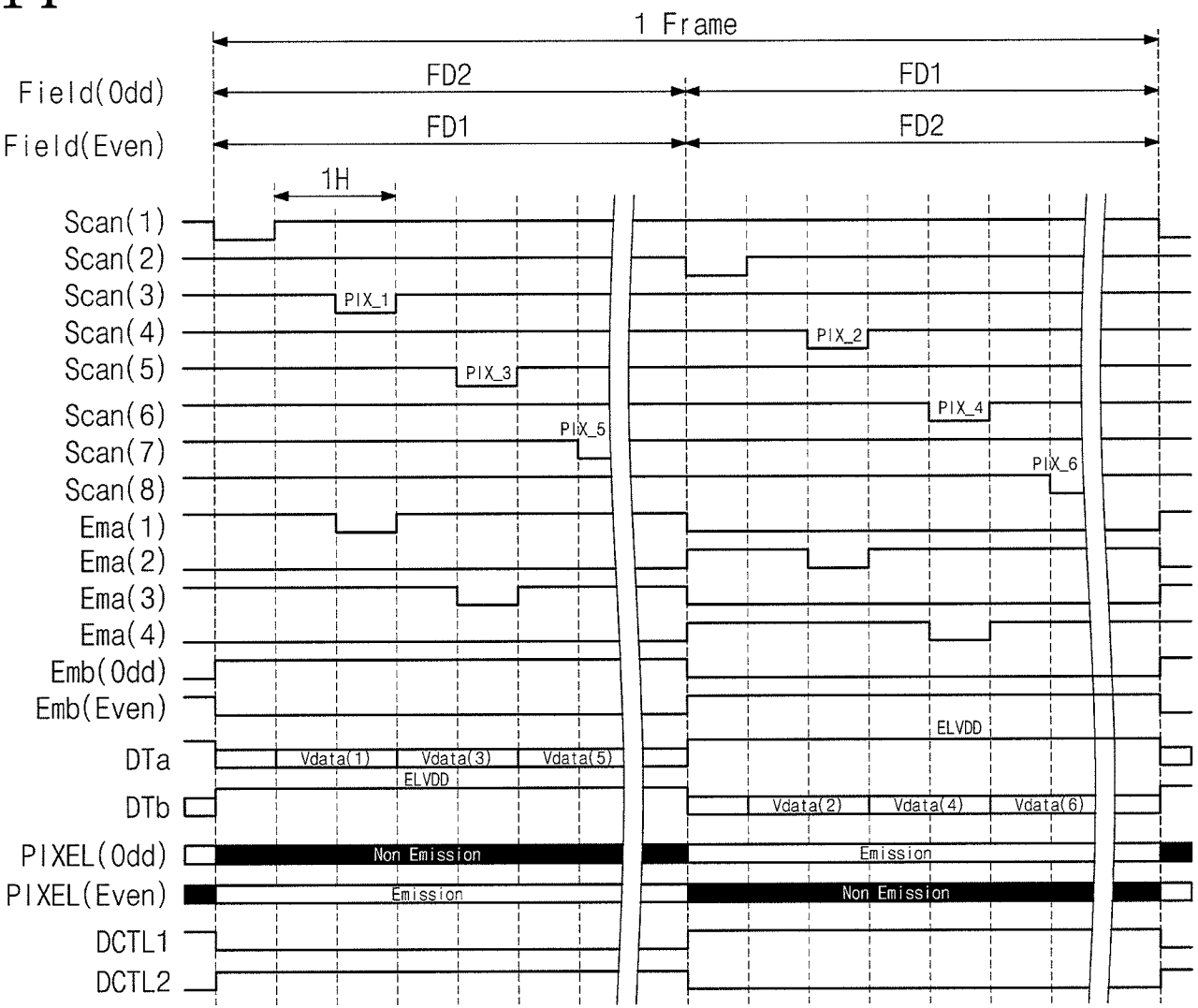
FIG. 14 illustrates a timing diagram for describing an operation of a circuit shown in FIG. 13.

FIG. 14 is a timing diagram for describing an operation of a circuit shown in FIG. 13. Like first and second embodiments, a frame period is divided into a first field FD1 and a second field FD2.

During a first field FD1 shown in FIG. 14, a first gate control signal DCTL1 of a conversion circuit is set to a low level and a second gate control signal DCTL2 is set to a high level. With this condition, a gray scale data voltage is supplied to a data line DTa and an anode voltage ELVDD is supplied to a data line DTb. At this time, an odd-numbered row of pixel circuits may correspond to a first field FD1, and an even-numbered row of pixel circuits may correspond to a second field FD2. Next, during a second field shown in FIG. 14, the first gate control signal DCTL1 of the conversion circuit is set to a high level and the second gate control signal DCTL2 thereof is set to a low level. With this condition, the anode voltage ELVDD is supplied to the data line DTa and the gray scale data voltage Vdata is supplied to the data line DTb. Alternatively, an odd-numbered row may correspond to the first field FD2, and an even-numbered row may correspond to the first field FD1.

Below, operations of a pixel circuit 100G at a first column and a second row and a pixel circuit 100H at the first column and a third row will be described with reference to a timing diagram shown in FIG. 14. Here, a description about a field of each pixel is omitted. First, the pixel circuit 100G is reset by setting a gate control signal Scan(1) to a low level. At this time, the pixel circuit 100A may correspond to an initialization interval (A).

Next, a gray scale data voltage Vdata(1) is supplied to a data line DTa to charge a data line 301. At this time, the pixel circuit 100G may correspond to a data line charging interval (B).

Then, a threshold voltage compensation operation of the pixel circuit 100G is performed by setting a gate control signal Scan(3) and a first emission control signal EMa(1) to a low level. During the same interval, also, the pixel circuit 100H is reset. At this time, the pixel circuit 100H may correspond to an initialization interval (A). Afterward, the threshold voltage compensation operation of the pixel circuit 100G and the initialization operation of the pixel circuit 100H are ended by setting the gate control signal Scan(3) and the first emission control signal EMa(1) to a high level.

After that, a data line 301 is charged by supplying the gray scale data voltage Vdata(3) as a data signal DTa. At this time, the pixel circuit 100H may correspond to a data line charge interval (B).

Finally, the threshold voltage compensation operation of the pixel circuit 100H is performed by setting the gate control signal Scan(5) and the first emission control signal EMa(3) to a low level. At this time, the pixel circuit 100H may correspond to the threshold voltage compensation interval (C).

As described above, an initialization operation, a data line charging operation, and a threshold voltage compensation operation about an odd-numbered row of pixel circuits in a panel are performed in a line-sequential manner. If gray scale data is written to all pixel circuits in an odd-numbered row of the panel, a field is switched, and light emitting elements emit light upon supplying of an anode voltage ELVDD to an odd-numbered row of pixels through the data line 301 (pixel circuits 100G and 100H corresponding to a light emitting interval (D)). In exemplary embodiments, during one field, gray scale data is written to an odd-numbered row of pixel circuits and an even-numbered row of pixel circuits emit light. During a next field, gray scale data is written to an even-numbered row of pixel circuits and an odd-numbered row of pixel circuits emit light. That is, a progressive driving method where pixel circuits in either an even-numbered row or an odd-numbered row emit light is used.

With the fourth embodiment, since pixel circuits corresponding to an odd-numbered row and pixel circuits corresponding to an even-numbered row are updated with gray scale data in the first field FD1 and the second field FD2, respectively, the number of lines to be updated with data may halved.

Also, in first to fourth embodiments, there is described an example where a circuit is formed of P-channel transistors. However, the embodiments are not limited thereto. For example, circuits according to the first to fourth embodiments may be formed of N-channel transistors or both N-channel transistors and P-channel transistors (CMOS type).

Also, in the first to fourth embodiments, there is described an example where a first field FD1 and a second field FD2 are controlled every odd-numbered row and every even-numbered row. However, the embodiments are not limited thereto. For example, a combination of rows controlled in the first and second fields FD1 and FD2 may be randomly selected.

In the first to fourth embodiments, 3D images may be provided in an active shutter manner by outputting an image for right eye to an odd-numbered row and an image for left eye to an even-numbered row.

With the first to fourth embodiments described above, the number of elements per pixel is reduced, and a pixel circuit with a conventional threshold voltage compensation capacity is provided. Thus, a panel becomes more precise, and a yield is improved. Further, since a data line is not directly connected to a driving transistor of controlling the amount of current to be supplied to a light emitting element, a voltage of a data signal transferred via the data line does not vary. Accordingly, a gate potential of the driving transistor may be maintained. Thus, image quality is improved by reducing or eliminating errors such as a crosstalk.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A pixel circuit, comprising:

a light emitting element to emit a gray scale of light based on a current supplied thereto;

a first transistor to control an amount of current supplied to the light emitting element based on a gray scale data voltage supplied to a gate electrode of the first transistor;

a second transistor connected between the gate electrode of the first transistor and an initialization voltage;

a third transistor connected between the gate electrode of the first transistor and a first terminal of the first transistor;

a fourth transistor connected between the first terminal of the first transistor and the light emitting element; and a fifth transistor connected between a second terminal of the first transistor and a data line to which the gray scale data voltage and a power supply voltage for light emitting of the light emitting element are selectively supplied, wherein:

a first field in which the gray scale data voltage is supplied to the data line and a second field in which the power supply voltage for light emitting of the light emitting element is supplied to the data line are alternated in turn, the third transistor is controlled by a gate control signal and the fifth transistor is controlled by a first emission control signal, and during the first field, the third transistor and the fifth transistor are turned on in response to the gate control signal and the first emission control signal such that the gray scale data voltage is supplied to the gate electrode of the first transistor, and then, the third transistor is turned off in response to the gate control signal.

2. The pixel circuit as claimed in claim 1, wherein:

the second transistor is controlled by a gate control signal corresponding to a previous pixel circuit and the fourth transistor is controlled by a second emission control signal, during the second field, the fifth transistor and the fourth transistor are turned on in response to the first emission control signal and the second emission control signal such that the power supply voltage is supplied to the light emitting element, and before the gray scale data voltage is supplied to the gate electrode of the first transistor, the second transistor is turned on in response to the gate control signal corresponding to the previous pixel circuit, so the initialization voltage is supplied to the gate electrode of the first transistor.

3. A method of driving a pixel circuit which includes a light emitting element outputting a gray scale based on a current supplied thereto, a first transistor configured to control an amount of current to be supplied to the light emitting element based on a gray scale data voltage supplied to a gate electrode of the first transistor; a second transistor connected between the gate electrode of the first transistor and an initialization voltage; a third transistor connected between the gate electrode of the first transistor and a first terminal of the first transistor; a fourth transistor connected between the first terminal of the first transistor and the light emitting element; and a fifth transistor connected between a second terminal of the first transistor and a data line, the method comprising:

selectively supplying the gray scale data voltage and a power supply voltage for light emitting of the light emitting element to the data line, supplying the gray scale data voltage to the gate electrode of the first transistor by turning on the third transistor and the fifth transistor, and then, turning off the third transistor, supplying the power supply voltage to the light emitting element by turning on the fifth transistor and the fourth transistor, wherein, before supplying the gray scale data voltage to the gate electrode of the first transistor, the initialization voltage is supplied to the gate electrode of the first transistor by turning on the third transistor.

4. The method as claimed in claim 3, wherein:

the pixel circuit has a first pixel circuit arranged at a first row and a second pixel circuit arranged at a second row, and an interval where a gray scale data voltage is supplied to the first pixel circuit and an interval where a gray scale data voltage is supplied to the second pixel circuit overlap during at least a portion of a 1 horizontal scan period.

5. The method as claimed in claim 3, wherein the method includes alternately repeating a first field in which the gray scale data voltage is supplied to the data line and a second field in which a power supply voltage for light emitting of the light emitting element is supplied to the data line.

6. The method as claimed in claim 5, wherein, during the first field, supplying the initialization voltage to the gate electrode of the first transistor.

7. The method as claimed in claim 5, wherein:

the pixel circuit has a first pixel circuit arranged in a first row and a second pixel circuit arranged in a second row, and supplying a voltage of the first field to one of a first data line connected to the first pixel circuit and a second data line connected to the second pixel circuit, and supplying a voltage of the second field to another of the first data line connected to the first pixel circuit and the second data line connected to the second pixel circuit.

8. The method as claimed in claim 7, further comprising supplying the initialization voltage to the gate electrode of the first transistor during the second field immediately following the first field in which the gray scale data voltage is supplied to the gate electrode of the first transistor.

* * * * *